US005964632A

United States Patent [19]

Makino

[11] Patent Number: 5,964,632

[45] Date of Patent: Oct. 12, 1999

[54] METHOD OF AND APPARATUS FOR MANUFACTURING OF CATHODE-RAY TUBE

[75] Inventor: Kanehiro Makino, Mizunami, Japan

[73] Assignee: Sony Corporation, Japan

[21] Appl. No.: 09/123,513

[22] Filed: Jul. 28, 1998

Related U.S. Application Data

[63] Continuation of application No. 08/636,533, Apr. 23, 1996, Pat. No. 5,863,234.

[30] Foreign Application Priority Data

Apr. 28, 1995 [JP] Japan ..... P7-106211

[51] Int. Cl.[6] ..... H01J 9/00; H01J 9/227

[52] U.S. Cl. ..... 445/30; 445/59

[58] Field of Search ..... 445/59, 30; 15/385

[56] References Cited

U.S. PATENT DOCUMENTS 2,290,533 7/1942 Campbell ..... 15/385

FOREIGN PATENT DOCUMENTS 33472 3/1977 Japan ..... 445/59

*Primary Examiner*—Kenneth J. Ramsey
*Attorney, Agent, or Firm*—Rader, Fishman & Grauer; Ronald P. Kananen

[57] ABSTRACT

After a phosphor layer is formed on an inner surface of a facepanel, panel pins which support color selection electrodes on the inner surface of the facepanel are cleaned immediately before the facepanel is sealed to a cathode-ray tube funnel.

4 Claims, 6 Drawing Sheets

METHOD OF AND APPARATUS FOR MANUFACTURING OF CATHODE-RAY TUBE

This application is a continuation of application Ser. No. 08/636,533 filed Apr. 23, 1996, now U.S. Pat. No. 5,863, 234.

BACKGROUND OF THE INVENTION

1. Field of the Invention

The present invention relates to a method of and an apparatus for manufacturing a cathode-ray tube.

2. Description of the Related Art

The phosphor screens of color cathode-ray tubes usually comprise a color phosphor screen of the so-called black matrix type which includes a black pattern serving as light absorbing films interposed between phosphor stripes (or dots) of red, green, and blue, for example. A metal back layer comprising an aluminum film, for example, is disposed on the color phosphor screen. A conductive carbon film for applying a high voltage to the metal back layer is coated between the metal back layer and panel pins of metal which support color selection electrodes on the inner surface of the facepanel. The high voltage is applied successively to an anode button, a conductive film within the cathode-ray tube funnel, contacts extending from the color selection electrodes, the color selection electrodes, the panel pins, the conductive carbon film, and the metal back layer.

One conventional process of manufacturing a color cathode-ray tube having such a color phosphor screen is shown in FIG. 1 of the accompanying drawings.

The inner surface of the facepanel of a cathode-ray tube is coated with a photosensitive film of PVA (polyvinyl alcohol), PVP (polyvinyl pyrrolidone), or the like. After the coated photosensitive film is dried, it is exposed to ultraviolet radiation using color selection electrodes as an optical mask and then developed with water or the like, forming stripes (or dots) of a resist layer in positions corresponding to respective colors. Then, the entire surface formed so far including the resist layer is coated with a carbon slurry. After the coated carbon slurry is dried, a reversal development process is carried out. That is, a reversal agent such as of $H_2O_2$ or the like is introduced to well the resist layer, and the resist layer and the carbon layer thereon are lifted off as by water washing or the like, thus forming carbon films serving as light absorbing films in a step 1.

Then, a green phosphor slurry is coated. After the coated green phosphor slurry is dried, it is exposed through the color selection electrodes, and then developed to form a green phosphor layer (phosphor stripes or dots) between predetermined carbon films in a step 2.

Thereafter, the panel pins are cleaned to remove any unwanted phosphor layer attached thereto in a step 3. The panel pins may be cleaned by applying a shower of water to the panel pins, immersing the panel pins in a chemical solution such as of ammonium fluoride or the like (so-called rinsing process), or physically scraping any unwanted phosphor layer off the panel pins with a rotating sponge or brush while water is being supplied (so-called trimming process).

Subsequently, a blue phosphor layer is formed in a step 4, and the panel pins are cleaned in a step 5. Similarly, a red phosphor layer is formed in a step 6, and the panel pins are cleaned in a step 7. A color phosphor screen is now completed.

Then, in preparation for forming a metal back layer, an intermediate film for providing a flat surface is coated on the color phosphor screen in a step 8. Thereafter, a metal back layer comprising an aluminum film is formed on the intermediate film in a step 9.

The panel pins are then coated with a conductive carbon film which electrically connects the panel pins and the metal back layer in a step 10.

Thereafter, with the color selection electrodes mounted on the panel pins, the facepanel is sealed to the cathode-ray tube funnel with frit in a step 11.

According to the conventional process of manufacturing a color cathode-ray tube as shown in FIG. 1, the cleaning steps 3, 5, 7 are carried out to remove any unwanted phosphor layer from the panel pins after the respective phosphor layers of the colors are formed.

It has been found out that after the phosphor screen is completed, debris is produced when panel pins are scraped upon attachment and detachment of color selection electrodes, and an unwanted conductive carbon layer attached to panel pins subsequently falls as debris, causing a reduction in the ability of the cathode-ray tube to withstand the high voltage.

If the panel pins are cleaned by immersing them in a solution of ammonium fluoride, then not all phosphor particles attached to the panel pins can be removed. If the panel pins are cleaned by physically scraping phosphor particles off the panel pins with a rotating brush or the like, then the panel pins have to be cleaned one at a time because of a limitation posed by the layout of the cleaning equipment, and it takes time to clean four guide pins, resulting in poor index. Furthermore, since the cleaning process requires the panel pins to be processed with water, it is difficult to clean a plurality of panel pins, e.g., four panel pins, at the same time due to mechanism complexities, and the cleaning process using water poses the problem of water splashes.

SUMMARY OF THE INVENTION

It is therefore an object of the present invention to provide a method of manufacturing a cathode-ray tube which is highly reliable by preventing the cathode-ray tube from suffering a reduction in the ability to withstand a high voltage due to debris falling from panel pins.

Another object of the present invention to provide an apparatus for manufacturing a cathode-ray tube, the apparatus having a cleaning device capable of cleaning a plurality of panel pins simultaneously.

According to the present invention, there is provided a method of manufacturing a cathode-ray tube, comprising the steps of forming a phosphor layer on an inner surface of a facepanel, and thereafter, cleaning panel pins which support color selection electrodes on the inner surface of the facepanel immediately before the facepanel is sealed to a cathode-ray tube funnel.

In the above method, since the panel pins are cleaned immediately before the facepanel is sealed to the cathode-ray tube funnel, debris that is produced when panel pins are scraped upon attachment and detachment of color selection electrodes, unwanted phosphor particles, and an unwanted conductive carbon layer (carbon particles) attached to panel pins can be removed from the panel pins. Consequently, the panel pins are free from the deposition of dirt or debris, and the cathode-ray tube which is manufactured is prevented from suffering a reduction in the ability to withstand a high voltage.

According to the present invention, there is also provided an apparatus for manufacturing a cathode-ray tube, comprising a plurality of as many pin cleaning members as the number of panel pins on an inner surface of a facepanel, a mechanism for moving the pin cleaning members toward and away from the panel pins, respectively, the pin cleaning members comprising respective covers having respective abutments on distal ends thereof for abutment against the inner surface of the facepanel and respective rotatable scraping members disposed in the respective covers for contacting the panel pins, respectively, and suction means for evacuating the covers.

In the above apparatus, the pin cleaning members are moved simultaneously into contact with the respective panel pins by the toggle mechanism, and clean the respective panel pins at the same time. The abutments on the distal ends of the covers abut against the inner surface of the facepanel, leaving a gap between the covers and the inner surface of the facepanel. The gap allows the covers to be evacuated without fail by the suction means. Specifically, the rotatable scraping members scrape off unwanted debris attached to surfaces of the panel pins, and the scraped-off debris is drawn and discharged from the covers by the suction means. Consequently, the panel pins are neatly cleaned simultaneously by the pin cleaning members. The abutments are effective to hold the covers out of contact with a metal back layer on the facepanel.

DETAILED DESCRIPTION OF THE PREFERRED EMBODIMENT

Figure 1:
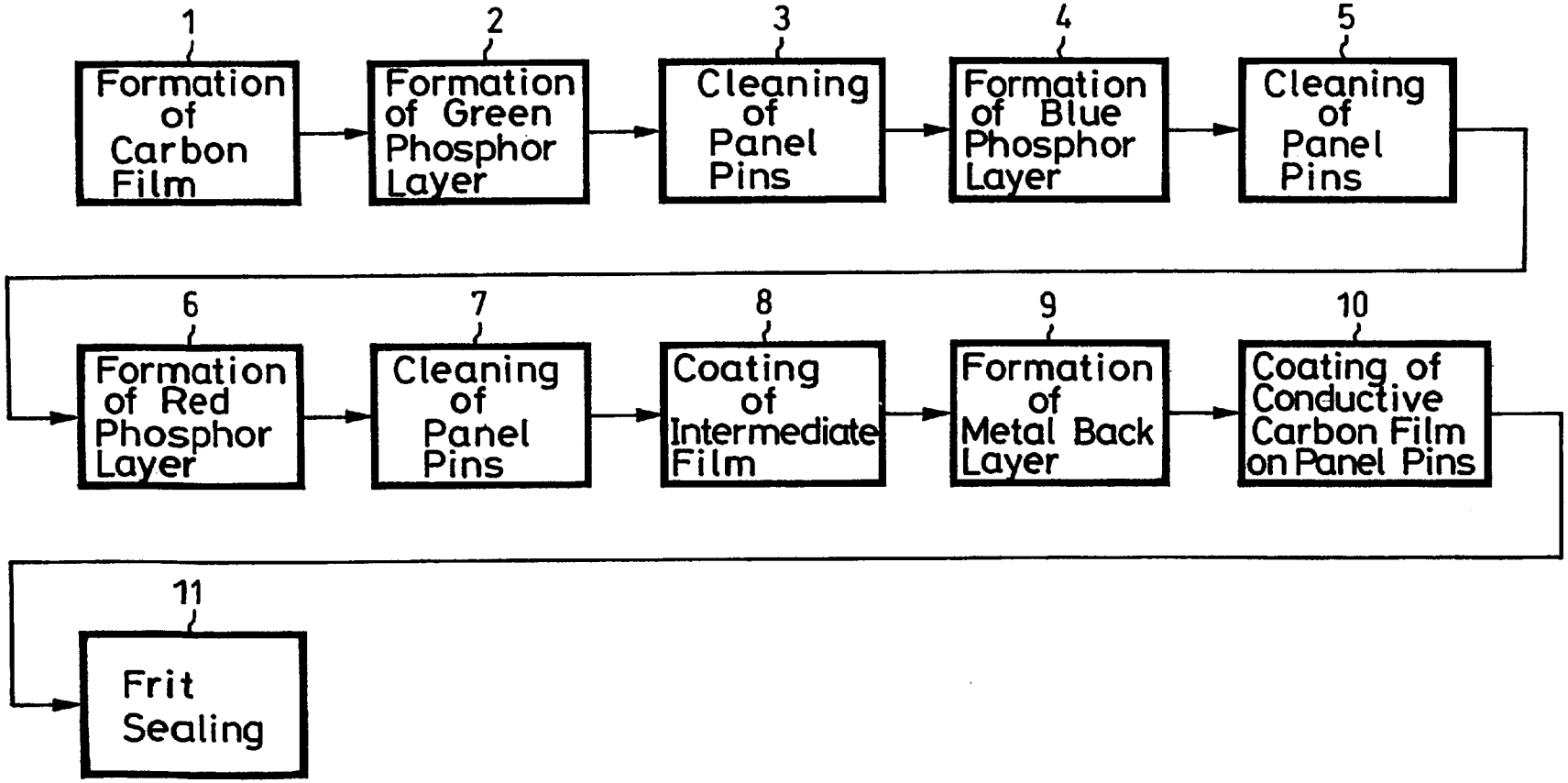
FIG. 1 is a block diagram showing a conventional process of manufacturing a color cathode-ray tube.
Figure 2:
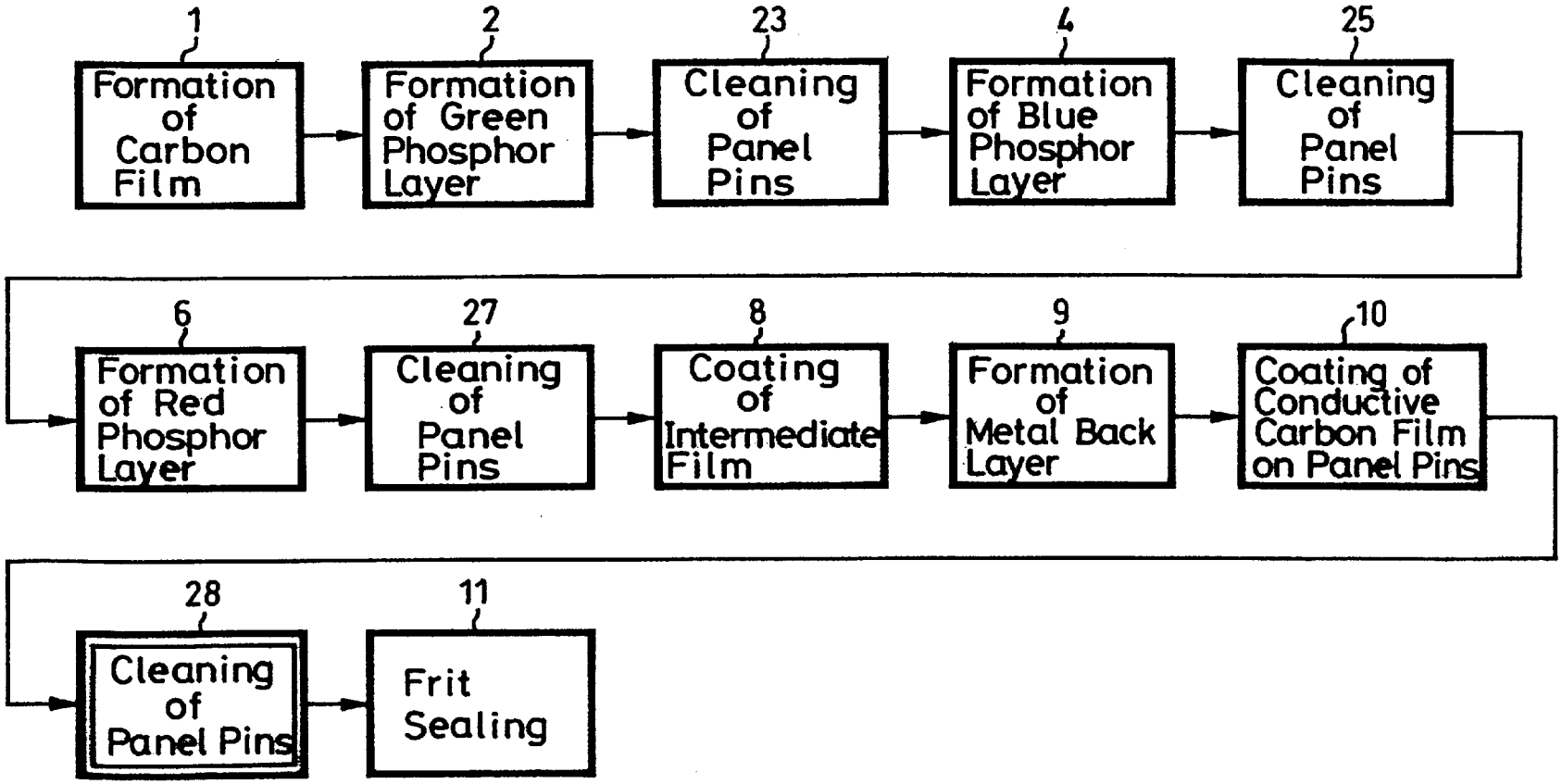
FIG. 2 is a block diagram showing a process of manufacturing a color cathode-ray tube according to the present invention.

FIG. 2 shows a process of manufacturing a color cathode-ray tube according to the present invention.

Figure 7:
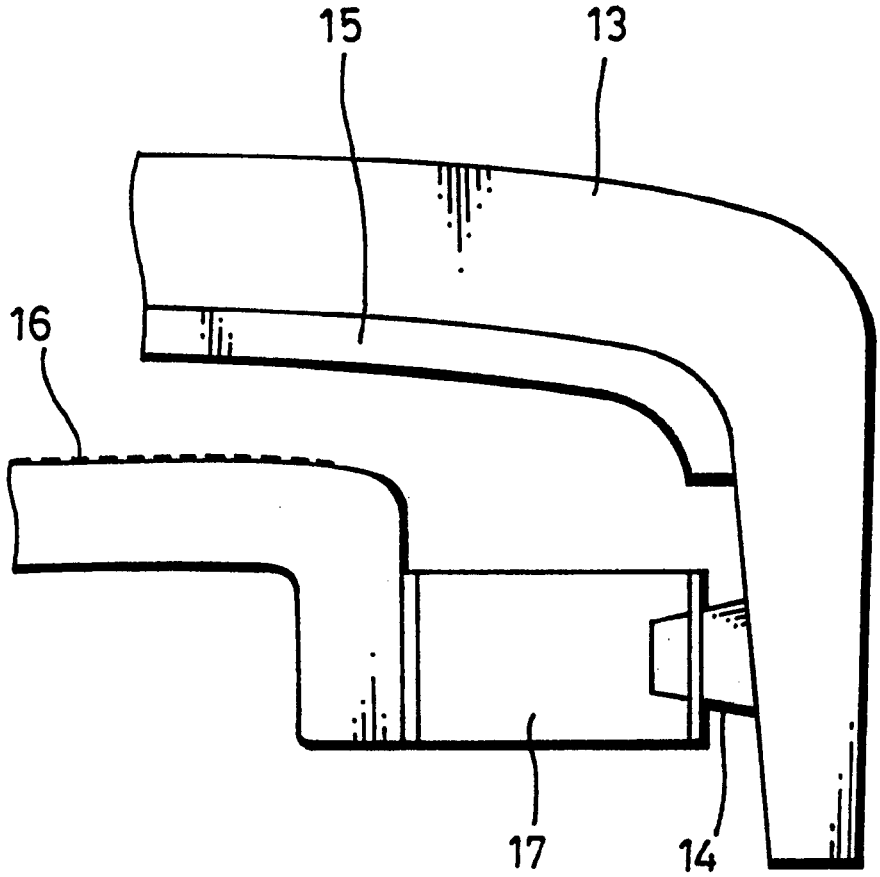
FIG. 7 is a fragmentary cross-sectional view of a cathode-ray tube which is being manufactured according to the present invention.

In the process of manufacturing a color cathode-ray tube according to the present invention, the inner surface of the facepanel of a cathode-ray tube is coated with a photosensitive film of PVA (polyvinyl alcohol), PVP (polyvinyl pyrrolidone), or the like. After the coated photosensitive film is dried, it is exposed to ultraviolet radiation using color selection electrodes as an optical mask, i.e., as shown in FIG. 7, with color selection electrodes 16 mounted on panel pins 14 of metal within the facepanel 13 by support springs 17 in confronting relation to the photosensitive film 15. Thereafter, the color selection electrodes 16 are removed, and the photosensitive film 15 is developed with water or the like, forming stripes (or dots) of a resist layer in positions corresponding to respective colors. Then, the entire surface formed so far including the resist layer is coated with a carbon slurry. After the coated carbon slurry is dried, a reversal development process is carried out to form a predetermined pattern of carbon films serving as light absorbing films in a step 1.

Then, a green phosphor slurry is coated. After the coated green phosphor slurry is dried, it is exposed through the color selection electrodes, and then developed to form a green phosphor layer (phosphor stripes or dots) between predetermined carbon films in a step 2. Thereafter, the panel pins 14 are cleaned to remove any unwanted phosphor layer attached thereto in a step 23.

Subsequently, a blue phosphor layer is formed in a step 4, and the panel pins are cleaned in a step 25. Similarly, a red phosphor layer is formed in a step 6, and the panel pins are cleaned in a step 27. A color phosphor screen is now completed.

Then, in preparation for forming a metal back layer, an intermediate film for providing a flat surface is coated on the color phosphor screen in a step 8. Thereafter, a metal back layer comprising an aluminum film is formed on the intermediate film in a step 9.

The panel pins 14 are then coated with a conductive carbon film which electrically connects the panel pins and the metal back layer in a step 10.

The panel pins 14 are cleaned by a cleaning device 31 (described later on) in a step 28.

Thereafter, with the color selection electrodes mounted on the panel pins 14, the facepanel is sealed to the cathode-ray tube funnel with frit in a step 11.

The cleaning device 31 is shown in FIGS. 3 through 6.

Figure 3:
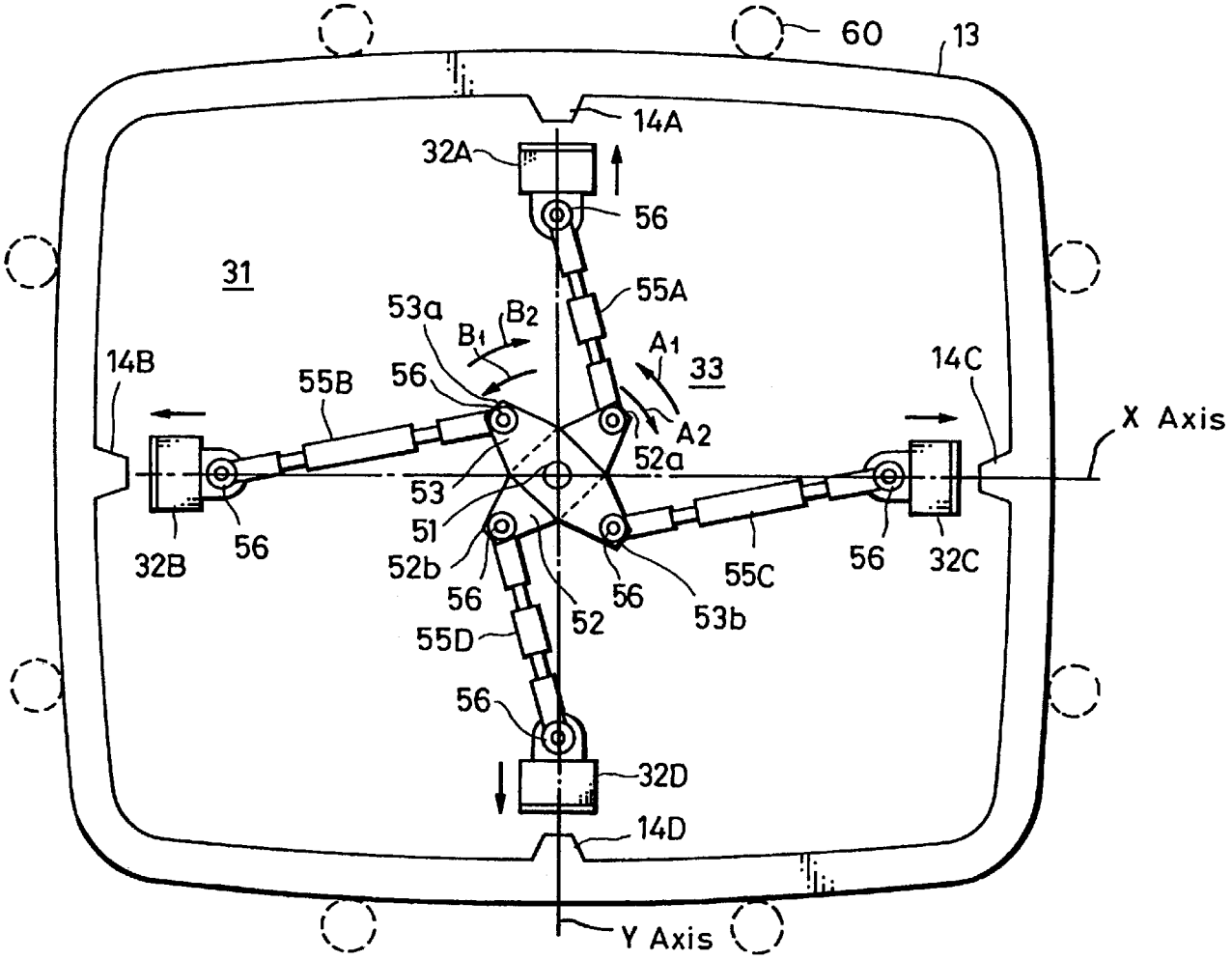
FIG. 3 is a plan view of a cleaning device for cleaning panel pins, of an apparatus for manufacturing a color cathode-ray tube according to the present invention.

As shown in FIG. 3, the cleaning device 31 comprises four pin cleaning members 32A, 32B, 32C, 32D for cleaning a plurality of panel pins within the facepanel 13, i.e., four panel pins 14A, 14B, 14C, 14D for supporting the color selection electrodes 16 in this embodiment, and a toggle mechanism 33 operatively coupled to the pin cleaning members 32A, 32B, 32C, 32D for moving the pin cleaning members 32A, 32B, 32C, 32D toward and away from the corresponding panel pins 14A, 14B, 14C, 14D simultaneously.

Figure 4:
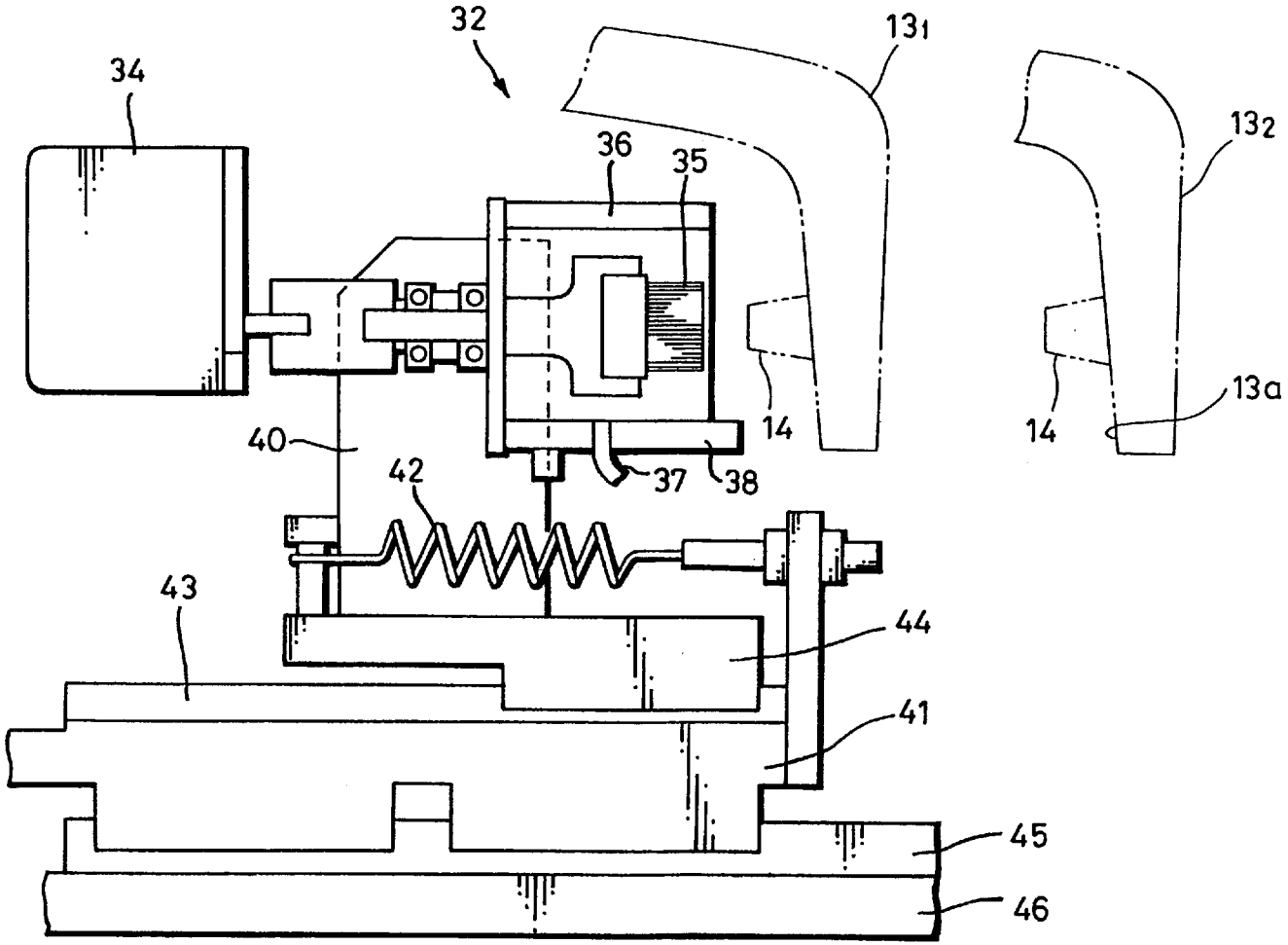
FIG. 4 is an enlarged fragmentary side elevational of the cleaning device shown in FIG. 3.
Figure 5:
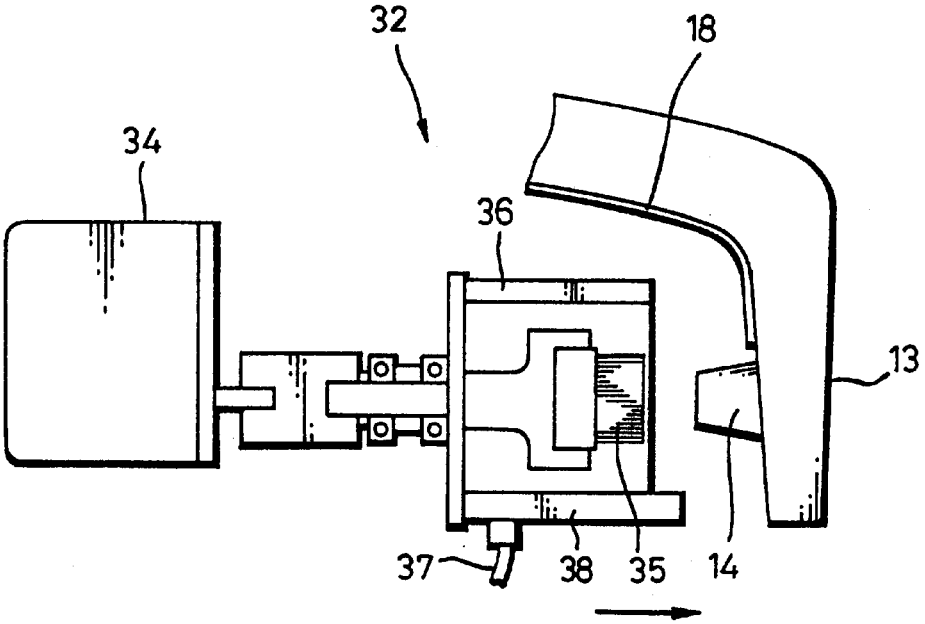
FIG. 5 is an enlarged fragmentary side elevational of the cleaning device, showing the manner in which the cleaning device operates.
Figure 6:
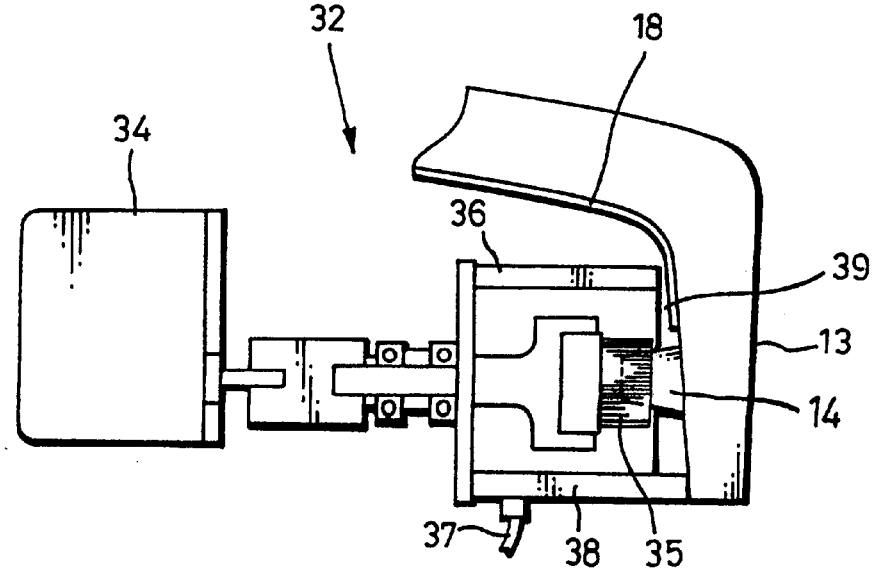
FIG. 6 is an enlarged fragmentary side elevational of the cleaning device, showing the manner in which the cleaning device operates.

In FIGS. 4 through 6, each of the pin cleaning members 32A, 32B, 32C, 32D is represented by a pin cleaning member 32, and each of the panel pins 14A, 14B, 14C, 14D is represented by a panel pin 14. In FIG. 4, the pin cleaning member 32 has a scraping member such as a rotating brush 35, for example, which can be rotated by a motor 34, a cover 36, i.e., a chamber, covering the rotating brush 35, and a suction device (not shown) connected through a hose 37 to the cover 36 for evacuating the cover 36 to collect dirt, debris, and other foreign matter from the cover 36.

The cover 36 has an abutment 38 on its outer distal end for abutment against an inner surface 13*a* of the facepanel 13 when the pin cleaning member 32 is moved toward the panel pin 14. The abutment 38 serves to provide a gap or clearance 39 (see FIG. 6) between the cover 36 and the facepanel 13 when the abutment 38 abuts against the inner surface 13*a*, holding the cover 36 out of contact with the phosphor screen and a metal back layer 18 thereon.

As shown in FIG. 4, the pin cleaning member 32 is supported on a support 40 movably mounted on a movable base 41 for movement along an X- or Y-axis, with a damper spring 42 acting between the support 40 and the movable base 41. The support 40 has a slider 44 slidably guided by a guide rail 43 on the movable base 41.

The movable base 41 is movably mounted on a guide rail 45 which is disposed on a fixed base 46 and extends along the X- or Y-axis.

The pin cleaning member 32 is movable in unison with the movable base 41 along the X- or Y-axis toward the panel pin 14. After the pin cleaning member 32 abuts against the inner surface 13*a* of the facepanel 13*a,* forces that are applied to move the pin cleaning member 32 toward the panel pin 14 are absorbed by the spring 42.

As shown in FIG. 3, the toggle mechanism 33 has first and second cam plates 52, 53 rotatably mounted on a shaft 51 for rotation about the shaft 51, and a plurality of toggle shafts 55A, 55B, 55C, 55D connected to the first and second cam plates 52, 53. Specifically, the toggle shaft 55A is operatively connected between an end 52*a* of the first cam plate 52 and a shaft 56 mounted on the first pin cleaning member 32A, the toggle shaft 55D is operatively connected between an opposite end 52*b* of the first cam plate 52 and a shaft 56 mounted on the fourth pin cleaning member 32D. The toggle shaft 55B is operatively connected between an end 53*a* of the second cam plate 53 and a shaft 56 mounted on the second pin cleaning member 32B, the toggle shaft 55C is operatively connected between an opposite end 53*b* of the second cam plate 53 and a shaft 56 mounted on the third pin cleaning member 32C. A first cylinder (not shown), for example, is connected between the movable base 41 of the first pin cleaning member 32A and the fixed base 46, and a second cylinder (not shown), for example, is connected between the movable base 41 of the second pin cleaning member 32B and the fixed base 46.

When the first cylinder is actuated, the first pin cleaning member 32A is moved, causing the toggle shaft 55A to turn the first cam plate 52 about the shaft 51 in the direction indicated by the arrow $A_1$ or $A_2$, whereupon the fourth pin cleaning member 32B connected to the toggle shaft 55D is moved. When the second cylinder is actuated, the second pin cleaning member 32B is moved, causing the toggle shaft 55B to turn the second cam plate 53 about the shaft 51 in the direction indicated by the arrow $B_1$ or $B_2$, whereupon the third pin cleaning member 32C connected to the toggle shaft 55C is moved. The four pin cleaning members 32A, 32B, 32C, 32D are now moved toward or away from the corresponding guide pins 41A, 14B, 14C, 14D simultaneously along the X- and Y-axes.

Operation of the cleaning device 31 will be described below.

The facepanel 13 is positioned in a cleaning position by positioning means 60 shown in FIG. 2 with respect to the X- and Y-axes such that the panel pins 14A, 14D are positioned on the Y-axis whereas the panel pins 14B, 14C are positioned on the X-axis.

Then, the toggle mechanism 33 is actuated to move the pin cleaning members 32A, 32B, 32C, 32D toward the respective guide pins 41A, 14B, 14C, 14D simultaneously. The each of the brushes of the pin cleaning members 32A, 32B, 32C, 32D is rotated by the motor 34, and air is drawn from the cover 36 by the suction device (see FIG. 5).

Each pin cleaning member 32 is moved until the abutment 38 of the cover 36 abuts against the inner surface 13*a* of the facepanel 13, and stops when the abutment 38 abuts against the inner surface 13*a* (see FIG. 6).

At this time, forces tending to press the cover 36 against the inner surface 13*a* are absorbed by the spring 42.

The rotating brush 35 enters the panel pin 14 and rubs against the surface of the panel pin 14, scraping dirt or debris off the panel pin 14. The dirt or debris scraped off the panel pin 14 is drawn from the cover 36 through the hose 37 by the suction device. Therefore, the four panel pins 14A, 14B, 14C, 14D are simultaneously cleaned. Since the gap 39 is maintained between the cover 36 and the inner surface 13A by the abutment 38, air is introduced through the gap 39 into the cover 36, and the dirt or debris is carried by the air into the hose 37. The cover 36 is prevented from contacting the metal back layer 18 because of the gap 39.

According to the illustrated embodiment, immediately before the facepanel 13 and the cathode-ray tube funnel are sealed to each other by frit, the four panel pins 14A, 14B, 14C, 14D are cleaned at the same time for removing debris which is produced after the color phosphor screen is completed in the step 8 until the time immediately before the facepanel 13 and the cathode-ray tube funnel are sealed to each other by frit, e.g., debris that is produced when panel pins 14 are scraped upon attachment and detachment of color selection electrodes, unwanted phosphor particles, and an unwanted conductive carbon layer (carbon particles) attached to panel pins 14.

Therefore, the color cathode-ray tube is prevented from suffering a reduction in its ability to withstand the high voltage, which would otherwise be caused by debris produced after the color phosphor screen is completed, and hence the color cathode-ray tube thus manufactured is highly reliable.

Inasmuch as the cleaning device 31 is capable of cleaning the four panel pins 14A, 14B, 14C, 14D simultaneously, the time required to clean the panel pins 14A, 14B, 14C, 14D is relatively short, resulting in improved index, and the layout of the cleaning device 31 is relatively simple.

Air is introduced into the cover 36 and drawn from the cover 36 in which the brush 38 is disposed. Therefore, the cleaning device 31 is free from the problem of water splashes which would otherwise occur if water were employed to clean the panel pins.

The toggle mechanism 33 is capable of adapting the cleaning device 31 to facepanels $\mathbf{13}_1$, $\mathbf{13}_2$ (see FIG. 4) of different sizes. Consequently, the cleaning device 31 requires no special preparation before it is used to clean the panel pins of the face panels of different types of cathode-ray tubes.

In the steps 23, 25, 27 of cleaning the panel pins 14 immediately after the respective phosphor layers are formed, the panel pins 14 may be cleaned by any of the conventional cleaning processes, e.g., by the process using a shower of water applied to the panel pins, the rinsing process of immersing the panel pins in a chemical solution, or the trimming process of physically scraping any unwanted phosphor layer off the panel pins with a rotating sponge or brush while water is being supplied. Alternatively, in the steps 23, 25, 27, the cleaning device 31 shown in FIGS. 3 and 4 may be used to scrape the panel pin 14 with the rotating brush 35 while water, rather than air, is being introduced into the cover 36 and discharged through the hose 37 by the suction device. According to the alternative proposal, the four panel pins 14 can be cleaned simultaneously without suffering the problem of water splashes.

Further alternatively, the cleaning device 31 shown in FIGS. 3 and 4 may be operated in its own mode of operation described above to clean the panel pins 14 in the steps 23, 25, 27.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

I claim:

1. A method of manufacturing a cathode-ray tube, comprising the steps of:

forming a phosphor layer on an inner surface of a facepanel;

cleaning panel pins which support color selection electrodes on the inner surface of the facepanel after each phosphor layer is formed;

coating panel pins with a conductive film;

dry-cleaning panel pins after the panel pins have been coated with the conductive film;

mounting the color selection electrodes on the panel pins immediately after the panel pins are dry-cleaned; and sealing the facepanel to a cathode-ray tube funnel immediately thereafter.

2. The method of manufacturing as claimed in claim 1, wherein said step of cleaning includes the step of cleaning a plurality of panel pins simultaneously.

3. The method of manufacturing as claimed in claim 1, wherein the steps of cleaning further includes the step of providing suction during cleaning of the panel pins to evacuate debris formed during cleaning.

4. A method of manufacturing a cathode-ray tube, comprising the steps of:

forming a phosphor layer on an inner surface of a facepanel;

cleaning a plurality of panel pins which support color selection electrodes on the inner surface of the facepanel simultaneously;

mounting the color selection electrodes on the panel pins immediately after the panel pins are cleaned; and sealing the facepanel to a cathode-ray tube funnel immediately thereafter.

* * * * *